US005199111A

United States Patent [19]

Antepenko

[11] Patent Number: 5,199,111

[45] Date of Patent: Apr. 6, 1993

[54] TOILET ODOR REMOVING APPARATUS

[76] Inventor: Daniel J. Antepenko, Rte. 1, Box 119, Spruce Pine, Ala. 35855

[21] Appl. No.: 754,078

[22] Filed: Sep. 3, 1991

[51] Int. Cl.[5] ..... E03D 9/05

[52] U.S. Cl. ..... 4/213; 4/209 R

[58] Field of Search ..... 4/213, 216, 217, 348, 4/209 R

[56] References Cited

U.S. PATENT DOCUMENTS

| | | | |
|---|---|---|---|
| 2,238,461 | 4/1941 | Carman | 4/213 |
| 4,168,553 | 9/1979 | Studer | 4/348 |
| 4,780,913 | 11/1988 | Williams | 4/217 |

FOREIGN PATENT DOCUMENTS

| | | | |
|---|---|---|---|
| 1252255 | 4/1989 | Canada | 4/213 |

*Primary Examiner*—William A. Cuchlinski, Jr.
*Assistant Examiner*—W. Morris Worth
*Attorney, Agent, or Firm*—John C. Garvin, Jr.

[57] ABSTRACT

An exhaust fixture for removing obnoxious odors from a bathroom. The exhaust fixture is adapted to be mounted on the flat upper surface of a conventional toilet bowl, behind the conventional toilet seat, by use of the same bolts and nuts which secures the conventional toilet seat to the toilet bowl. The exhaust fixture includes a hollow chamber having a plurality of spaced holes facing the oval openings of both the toilet bowl and the toilet seat, a pair of hollow pipes in communication with the hollow chamber, each in communication with one of the hollow pipes and a remotely located exhaust fan.

3 Claims, 2 Drawing Sheets

TOILET ODOR REMOVING APPARATUS

TECHNICAL FIELD

This invention relates to a toilet bowl ventilation system, and more particularly to a simple apparatus adapted for easy mounting and use with conventional toilets or water closets for removing odors from the toilet bowl of such conventional toilets or water closets.

BACKGROUND OF THE INVENTION

Systems for removing obnoxious odors from bathrooms have been commercially available and in use for many years. Such system typically provide for a vent located in the ceiling or wall, adjacent to the ceiling, of the bathroom with a fan located above the vent for withdrawing air, which includes the obnoxious odors, from the entire bathroom. The disadvantage or drawback with this typical system is that the odor removing equipment is not positioned close to the source of the odor, namely the toilet bowl. Such commercially available systems require that a large volume of air be exhausted from the bathroom to ensure the removal of the obnoxious odors.

The prior art also includes a limited number of United States patents which disclose odor removing equipment positioned closer to the source of the odor. U.S. Pat. Nos. 3,887,949, 4,117,559, 4,168,553 and 4,175,293 are examples of ventilation systems for toilets which include a fixture mounted on the flat upper surface of a toilet bowl on its back side. U.S. Pat. Nos. 1,695,530, 3,916,459, 3,733,619, 4,094,023, 4,125,906 and 4,556,999 are examples of toilet ventilation systems which are partially incorporated into specially constructed toilet seats for removing obnoxious odors from the toilet bowl.

Most of the prior art odor removing devices disclosed in the patents have the major disadvantage or drawback of not being adapted for easy mounting and use with conventional toilets or water closets. Many of the patented prior art systems for removing odor from toilet bowls also have the disadvantage or drawback in that specially designed and constructed toilet seats are required for use with such systems. A still further disadvantage or drawback of most of the patented prior art systems reside in their technical complexity and relatively high cost. Many of the patented prior art systems also have the disadvantage or drawback of relying on filters or deodorizers for assistance in removing obnoxious odors from the bathroom.

SUMMARY OF THE INVENTION

The instant invention relates to a ventilation system for removing obnoxious odors from a bathroom, which is relatively simple and inexpensive in construction, adapted to be easily installed on a conventional toilet or water closet, and to overcome the several disadvantages and drawbacks of prior art bathroom ventilation systems. The instant invention is comprised of an exhaust fixture for mounting on the flat upper surface of a toilet bowl behind the conventional toilet seat by use of the same bolts and nuts which secures the conventional toilet seat to the toilet bowl. The exhaust fixture includes a hollow chamber having a plurality of spaced holes therein facing toward the oval openings of both the toilet bowl and the toilet seat, a pair of hollow pipes in communication with the hollow chamber, and a pair of hose members, each in communication with one of the hollow pipes and a remotely located exhaust fan.

It is an object of the present invention to provide a simple, inexpensive and easy to manufacture and install toilet bowl odor removing apparatus.

It is a further object of the present invention to provide a toilet bowl odor removing apparatus which is easily installed in part on a conventional toilet bowl and remains always near the source of the odor.

It is still a further object of the present invention to provide a toilet odor removing apparatus which can be readily and easily, partially, removed from the toilet bowl to permit the cleaning of portions thereof which are normally located in close proximity to the toilet bowl.

These objects as well as other aspects, objects and advantages of the present invention will become apparent to those skilled in the art after reading the following description of the preferred embodiment in conjunction with the accompanying drawings, and the appended claims.

DETAILED DESCRIPTION OF THE INVENTION

Figure 1:
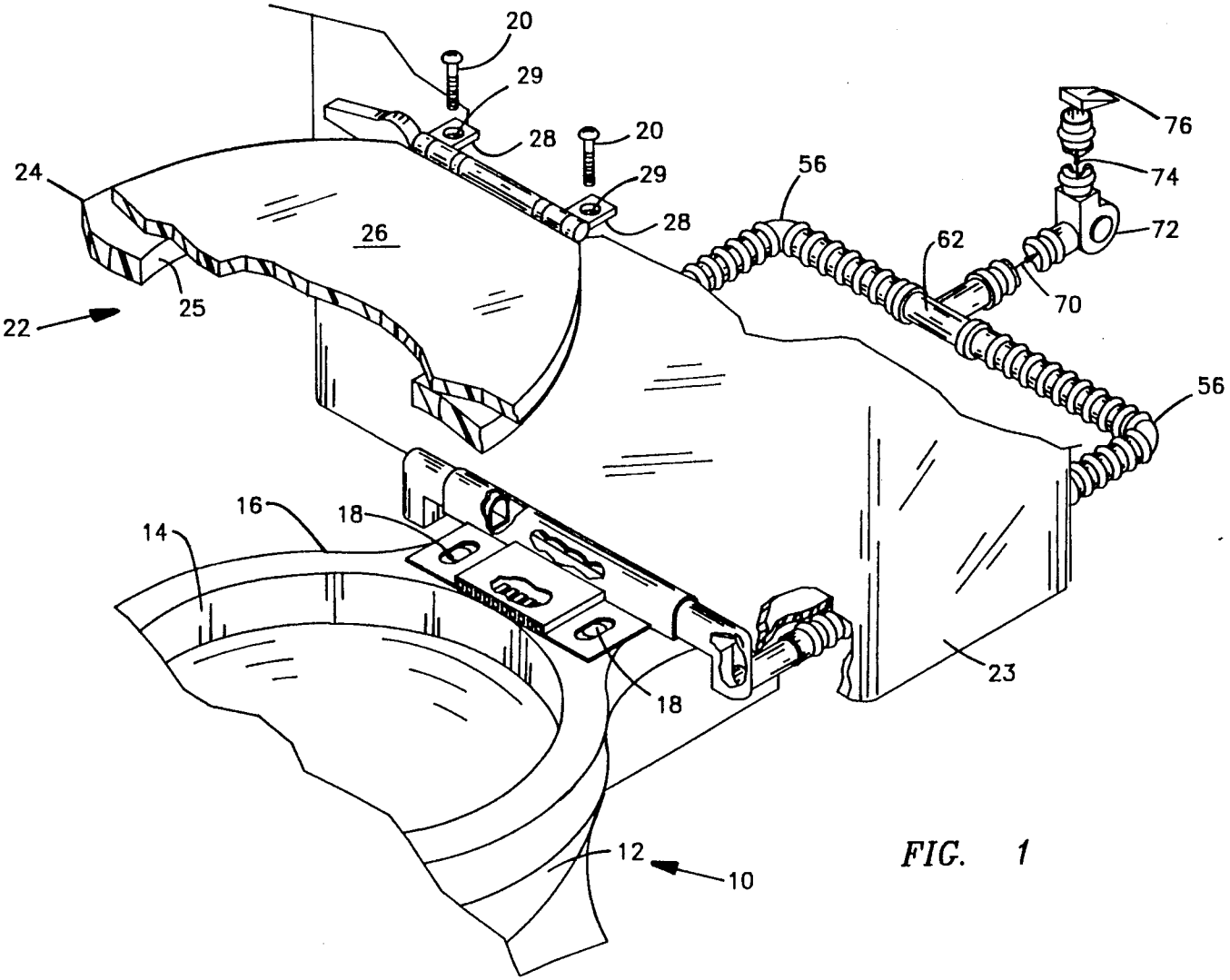
FIG. 1 is a perspective view of the preferred embodiment of the present invention with portions of the invention and the conventional toilet being broken away.
Figure 2:
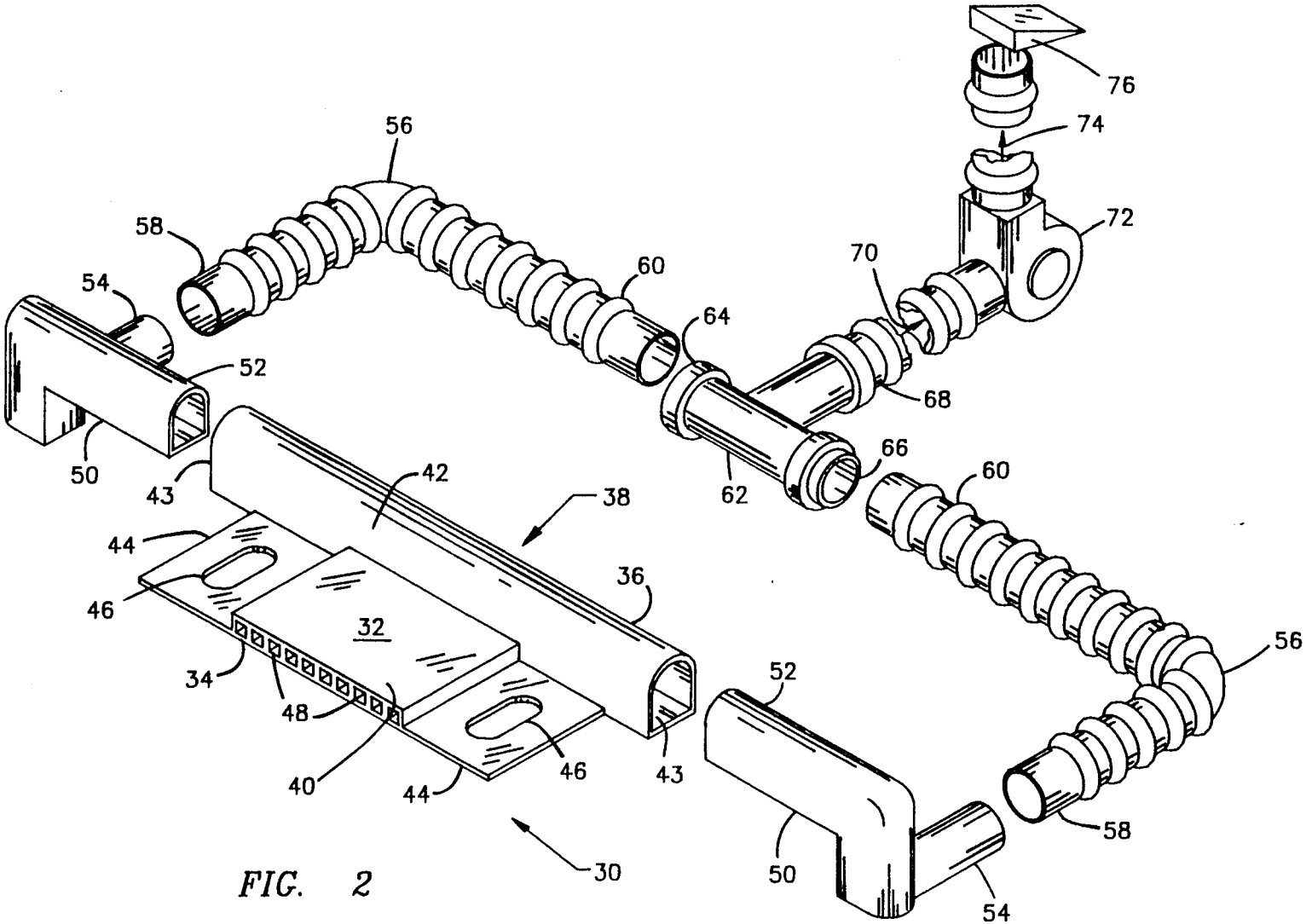
FIG. 2 is an exploded view of the preferred embodiment of the toilet bowl ventilation system of the present invention.

Referring now to the drawings, FIGS. 1 and 2 illustrate, by way of example, the preferred embodiment of the present invention. Reference numeral 10 (FIG. 1) generally designates a conventional toilet or water closet that includes a toilet bowl 12 having an oval interior opening 14 therein with major and minor axes, an upper surface or rim 16, a pair of spaced parallel bores 18 for accommodating the bolts 20 of a conventional toilet seat 22, and a water reservoir tank 23. Conventional toilet seat 22 includes a seat 24 having an oval opening 25 therein and a lid 26 pivotally connected to seat 24 by a pair of hinges 28. Each of hinges 28 has a bores 29 therein for receiving the bolts 20 of conventional toilet seat 22.

Referring now to FIG. 2, reference numeral 30 generally designates the preferred embodiment of the toilet odor removing apparatus of the present invention. Apparatus 30 comprises an exhaust fixture 32 having a front edge 34, a rear or back edge 36, a hollow chamber 38 divided into a hollow reduced portion 40 extending from front edge 34 and an enlarged hollow portion 42 extending along back edge 36, each in communication with openings 43 in each end of enlarged hollow portion 42, a flat plate 44 attached to and on each side of reduced portion 40 of hollow chamber 38, an oblong hole 46 in each of flat plates 44 spaced the same distance apart as bores 18 in upper surface 16 of toilet bowl 12 and bores 29 in each of hinges 28 of toilet seat 22, a plurality of openings 48 in front edge 34 of exhaust fixture 32 in communication with reduced portion 40 of hollow chamber 38, and a pair of generally L-shaped hollow pipes 50, each having a first end 52 adapted for telescoping within one of the openings 43 in enlarged hollow portion 4 of exhaust fixture 32 and a second end 54.

A pair of hose members 56, each having a first end 58 and a second end 60 is attached at their first ends 58 to the second end 54 of a respective generally L-shaped hollow pipe 50. The second end 60 of each hose member 56 is attached to a T-fitting 62 at its openings 64 and 66, and opening 68 of T-fitting 62 is in communication through a pipe or hose 70 with a conventional blower 72. Blower 72 is in communication with an area outside the bathroom through a pipe or hose 74 connected to blower 72 and a vent 76 leading to the outside atmosphere.

Preferably, hose members 56 and T-fitting 62 will be located primarily between the studs (not shown) and be hidden by the sheetrock or other material (not shown) forming the wall behind water reservoir tank 23. The exhaust fan 72, pipe 74 and vent 76 are preferably located overhead in the attic (not shown) with vent 76 leading to an outside area. A damper (not shown might also be included. The exhaust fan 72 is in an electrical circuit operated by a conventional switch (not shown) mounted in the bathroom.

The exhaust fixture 32, generally L-shaped pipes 56 and T-fitting 62 are preferably made of a hard plastic material, but may be made of metal or other materials. The hose members 56, 70 and 74 can be made of any conventional material such as plastic or rubber.

While the above description constitutes a preferred embodiment of the present invention, it will be appreciated that the invention is susceptible to modification, variation and change without departing from the proper scope and fair meaning of the accompanying claims.

I claim:

1. A toilet odor removing apparatus for a toilet bowl having a generally oval opening therein having a major axis and a minor axis, said generally oval opening being surrounded by a generally flat upper surface having a pair of spaced parallel bores formed therethrough on a back side of the toilet bowl for accommodating bolts for anchoring a toilet seat, said toilet odor removing apparatus comprising:

an exhaust fixture, dimensioned to fit upon said back side of said toilet bowl, including a front edge having a plurality of openings therein which are in substantial alignment with said oval opening of said toilet bowl, a rear edge, a hollow chamber in communication with said one or more openings in said front edge and extending to said rear edge, a flat plate secured along a portion of each side of said hollow chamber, each of said plates having an apertures therethrough spaced the same distance apart as said bolts for anchoring said toilet seat, said apertures being oblong in shape to allow for possible adjustment of said exhaust fixture in a direction parallel to said major axis of said oval opening of said toilet bowl toward and way from said minor axis of said generally oval opening of said toilet bowl, and a pair of spaced openings in said hollow chamber adjacent said rear edge of said exhaust fixture;

a pair of generally L-shaped pipes, each having a first end and a second end, said first end being of the same cross-sectional configuration as said spaced openings in said hollow chamber and being adapted to be telescopically received within said spaced openings;

a pair of hoses, each having a first end and a second end, said first end of each hose being secured to said second end of a respective one of said generally L-shaped pipes;

an exhaust outlet in communication with the outside atmosphere; and blower means mounted in an area remote from said toilet bowl and being in communication with each said second end of said hoses and with said exhaust outlet.

2. The toilet odor removing apparatus of claim 1 wherein said hollow chamber of said exhaust fixture comprises a reduced portion which is in communication with said one or more openings in said front edge of said exhaust fixture, and an enlarged portion which incorporates said pair of spaced openings adjacent said rear edge of said exhaust fixture.

3. A toilet odor removing apparatus for a toilet bowl having a generally oval opening therein having a major axis and a minor axis, said opening being surrounded by a generally flat upper surface which incorporates a pair of spaced bores therethrough on a back side of the toilet bowl for accommodating bolts for anchoring a toilet seat, said toilet odor removing apparatus comprising:

an exhaust fixture, dimensioned to fit upon said back side of said toilet bowl, including a front edge having a plurality of openings therein in substantial alignment with said oval opening of said toilet bowl, a rear edge, a hollow reduced portion in communication with said openings in said front edge, an enlarged portion forming a part of said back edge in communication with said reduced portion and having a pair of hollow spaced openings, and a pair of plates secured to the sides of said reduced portion and to the front of said enlarged portion, each of said plates having an oblong aperture therein spaced apart the same distance as said bores in said upper surface of said toilet bowl, said apertures being oblong in shape to allow for possible adjustment of said exhaust fixture in a direction parallel to said major axis of said oval opening of said toilet bowl toward and away from said minor axis of said generally oval opening of said toilet bowl;

a pair of generally L-shaped hollow members, each having distal ends, one of which is of the same cross-sectional configuration as said spaced openings in said enlarged portion of said exhaust fixture and being adapted to be telescopically received within said spaced openings;

a pair of flexible hose elements, each having a first end and a second end, said first end of each hose element being fastened to the other of the distal ends of a respective one of said generally L-shaped hollow members;

a T-fitting fastened to each of said second ends of said flexible hose elements;

an exhaust outlet in communication with the outside atmosphere; and blower means mounted remotely from said toilet bowl in communication with said T-fitting and said exhaust outlet.

* * * * *